US007647009B2

(12) United States Patent
Deguchi et al.

(10) Patent No.: US 7,647,009 B2
(45) Date of Patent: Jan. 12, 2010

(54) DEVELOPING APPARATUS FOR STIRRING AND SUPPLYING DEVELOPER UNIFORMLY TO A DEVELOPING ROLLER

(75) Inventors: Masanobu Deguchi, Kashiba (JP); Kazuya Koyama, Ikoma (JP); Teruyoshi Sudoh, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 411 days.

(21) Appl. No.: 11/408,068

(22) Filed: Apr. 21, 2006

(65) Prior Publication Data

US 2006/0239718 A1 Oct. 26, 2006

(30) Foreign Application Priority Data

Apr. 22, 2005 (JP) ..... 2005-125775

(51) Int. Cl.
*G03G 15/08* (2006.01)

(52) U.S. Cl. ..... 399/254

(58) Field of Classification Search ..... 399/315, 399/316, 343, 254, 256, 263
See application file for complete search history.

(56) References Cited

U.S. PATENT DOCUMENTS 4,855,783 A * 8/1989 Takashima et al. ..... 399/256
4,980,724 A * 12/1990 Tanaka ..... 399/256
4,989,539 A * 2/1991 Ichikawa ..... 399/256
5,249,019 A * 9/1993 Ishida et al. ..... 366/318
5,572,297 A * 11/1996 Kawashima ..... 399/257
5,682,584 A * 10/1997 Hattori et al. ..... 399/255
5,842,090 A * 11/1998 Mikawa ..... 399/256
6,266,504 B1 * 7/2001 Katoh ..... 399/256
7,079,793 B2 * 7/2006 Amano et al. ..... 399/254

FOREIGN PATENT DOCUMENTS

EP 250793 A2 * 1/1988
JP 62-291682 A 12/1987
JP 07-244425 9/1995
JP 2004184496 A * 7/2004
JP 2005-266406 9/2005

* cited by examiner

*Primary Examiner*—Robert Beatty
(74) *Attorney, Agent, or Firm*—Nixon & Vanderhye P.C.

(57) ABSTRACT

A developing apparatus having agitating/supplying section which is capable of providing enhanced developer stirrability and supplying a developer to a developing roller uniformly in its lengthwise direction is provided. The developing apparatus installed in an electrophotographic image forming apparatus includes an agitating/supplying section composed of: a rotary shaft member which is made rotatable about its rotation axis; a plurality of blade support members disposed intersectionally with respect to the rotation axis of the rotary shaft member; and a plurality of blade members formed between respective adjacent blade support members so as to be arranged around the rotation axis of the rotary shaft member and extend in a direction of the rotation axis.

18 Claims, 8 Drawing Sheets

DEVELOPING APPARATUS FOR STIRRING AND SUPPLYING DEVELOPER UNIFORMLY TO A DEVELOPING ROLLER

BACKGROUND

The disclosed technology relates to a developing apparatus designed for use in an electrophotographic image forming apparatus.

In general, an image forming apparatus that utilizes electrophotography technique is constructed by arranging a charging section, an exposure section, a developing section, a transfer section, a fixing section, a cleaning section, and an electricity removing section around a rotatable image bearing member. The charging section applies electric charge uniformly over the entire surface of the image bearing member. In the exposure section, the electrically charged surface of the image bearing member is exposed to light in accordance with image information to form an electrostatic latent image thereon. In the developing section, toner is agitated so as to be electrically charged by friction, and the frictionally-charged toner is then caused to adhere to the electrostatic latent image formed on the surface of the image bearing member, whereupon a toner image is obtained. In the transfer section, electric charge of a polarity which is reverse to the polarity of the charged toner is applied to a recording medium, so that the toner image can be transferred onto the recording medium. In the fixing section, the toner image transferred onto the recording medium is fixed into place by application of heat, pressurization, or the like. The cleaning section removes and collects part of the toner which remains on the surface of the image bearing member because of not having been transferred onto the recording medium. The electricity removing section carries out removal of electricity from the surface of the image bearing member after the transfer of the toner image is completed. Thus constructed, the image forming apparatus that utilizes electrophotography technique is capable of forming a desired image on the recording medium.

A developing apparatus designed to develop an electrostatic latent image in the course of image formation based on an electrophotographic process is typically composed of a developing roller, a developer container for housing a developer, and a section for agitating and supplying a developer, such as an agitating roller. The developing roller is freely rotatably disposed so as to face an image bearing member. The image bearing member is exposed to light in accordance with image information to form an electrostatic latent image thereon. The agitating/supplying section agitates the developer housed in the developer container and supplies the agitated developer to the developing roller. In general, there are two methods for performing development: a mono-component developer development process and a dual-component developer development process.

In the mono-component developer development process, a layer consisting solely of toner is formed on the surface of the developing roller, and the layer is then caused to adhere to a static charge image formed on the surface of the photoreceptor. On the other hand, in the dual-component developer development process, magnetic particles, being called "carrier", and toner are agitated together so as to be electrically charged by friction. The resulting toner-holding carrier is, on the surface of the developing roller having a magnet member inside, caused to stand magnetically in a spicate or ear-like form, thereby forming a so-called "magnetic brush". In this state, the toner is electrostatically attached to the static charge image formed on the surface of the photoreceptor. In the case of adopting the dual-component developer development process, in contrast to the mono-component developer development process, it is inevitable that the structure of the apparatus will be somewhat complicated. However, with the advantages of relative easiness in setting the potential of the toner and excellence in high-speed adaptability and stability, the dual-component developer development process is generally employed in a middle-to-high speed printer.

As an example of developing apparatuses that adopt such a dual-component developer development process, there is proposed a developing apparatus having paddle-type agitating/supplying section that succeeded in cost reduction and miniaturization by reducing the number of constituent components to a minimum without impairing the developer stirrability thereof (for example, refer to Japanese Unexamined Patent Publication JP-A 7-244425 (1995)).

FIG. 7 is a sectional view showing the simplified constitution of a developing apparatus 1 having paddle-type agitating/supplying section 5. FIG. 8 is a perspective view showing the developing apparatus 1 depicted in FIG. 7.

The developing apparatus 1 is composed of: a developing roller 3; a developer container 4; an agitating/supplying section 5; a developer regulating member 6; a runner plate 7; and a toner concentration sensor 8. The developing roller 3 is freely rotatably disposed so as to face a photoreceptor drum 2, namely an image bearing member, for forming an electrostatic latent image thereon when exposed to light in accordance with image information. The developer container 4 accommodates therein a developer including toner and carrier. The agitating/supplying section 5 agitates the developer housed in the developer container 4 and supplies the agitated developer to the developing roller 3. The developer regulating member 6 regulates the amount of the developer rising in a spicate form formed on the outer peripheral surface of the developing roller 3. Part of the developer which has been moved away from the outer peripheral surface of the developing roller 3 by the developer regulating member 6 is run downflow through the runner plate 7 toward the agitating/supplying section 5. The toner concentration sensor 8 detects the concentration of the toner housed in the developer container 4. In addition, the developing apparatus 1 is equipped with a non-illustrated toner hopper for housing the toner constituting the developer. The toner hopper serves also to feed the toner into the developer container 4.

For example, the developer container 4 for accommodating therein a developer is made of hard synthetic resin. The developing roller 3 and the agitating/supplying section 5 are freely rotatably supported by the developer container 4. Inside the developer container 4 is housed a dual-component developer including toner and carrier. Moreover, an opening is formed at the photoreceptor drum 2-facing position of the developer container 4. The developer container 4 is situated so as to face the photoreceptor drum 2, with part of it left exposed through the opening. Therein, the developing roller 3 is spaced a short distance away from the photoreceptor drum 2.

The developing roller 3 is constituted as a so-called magnet roller composed of a rotatable non-magnetic developing sleeve 9 and a stationary magnet member having a plurality of magnetic poles. The developing sleeve 9 is formed of a cylindrical-shaped member made of aluminum or the like material. The magnet member situated inside the developing roller 3 is disposed in such a way that two opposite polarities are arranged circumferentially in substantially an alternating manner. More specifically, the magnet member is disposed in such a way that, in the toner-conveying region including the photoreceptor drum 2-facing development area of the developing roller 3, the magnetic poles of opposite polarities, namely S3, N2, S1, N1, S2, N3, and S4, are successively arranged in the order named, whereas in the freed area of the developing roller 3 located opposite to the development area, the magnetic poles of the same polarity, namely S4 and S3, are adjacent to each other.

The developing roller 3 attracts the developer, namely the toner-holding carrier, under a magnetic force of its own, to cause it to stand magnetically in a spicate or ear-like form, thereby forming a so-called "magnetic brush" on the developing sleeve 9. By driving the developing sleeve 9 to rotate in a direction indicated by an arrow 9*a*, the developer can be conveyed by the developing roller 3 toward the development area where the developing roller 3 and the photoreceptor drum 2 confront each other most proximately. Of the constituent elements of the developer, only the toner can be fed to the photoreceptor drum 2 by exploiting the difference between the potential of the photoreceptor drum 2 and the bias potential of the developing roller 3. Eventually, an electrostatic latent image formed on the photoreceptor drum 2 is developed to form a toner image.

The developer regulating member 6 is designed as a thin platy member made of, for example, stainless steel. The developer regulating member 6 has its one end (free end) spaced a predetermined distance, namely a distance equal to the length of the magnetic brush to be created, away from the outer peripheral surface of the developing roller 3, and has its other end fitted to the developer container 4.

The agitating/supplying section 5 includes a rotary shaft member 10, paddle-like blade members 11 and a plurality of scooping members 12. The rotary shaft member 10 is disposed so that its axis is in parallel with the axis of the developing roller 3, and is made rotatable about its axis. The parallely-arranged blade members 11 are each angled relatively to a rotation axis 10*a* of the rotary shaft member 10. The scooping member 12 is disposed in parallel with the rotation axis 10*a* transversely of the blade member 11. Note that the scooping member 12 is angularly displaced by 180 degrees with respect to the rotation axis 10*a*. The rotary shaft member 10, the blade members 11, and the scooping members 12 are formed integrally with one another. The blade member 11 agitates the developer in accompaniment with the rotation of the rotary shaft member 10, and supplies the agitated developer in a frictionally-charged state to the developing roller 3. The scooping member 12 scoops upwardly the developer present in the bottom portion of the developer container 4.

The agitating/supplying section 5 is driven to rotate in a direction indicated by an arrow 5*a*, which is identical with the rotation direction 9*a* of the developing sleeve 9 of the developing roller 3, to agitate the developer so as for the carrier and the toner contained therein to be admixed with each other evenly. The agitated developer is supplied from the agitating/supplying section 5 to the developing roller 3.

The developer container 4 is provided with the toner concentration sensor 8 for detecting the concentration of the toner contained in the developer housed in the developer container 4. The toner concentration sensor 8 is disposed so as to face the agitating/supplying section 5. The ratio of the toner to the carrier in the developer is detected by the toner concentration sensor 8. When the value detected by the toner concentration sensor 8 is equal to or less than a predetermined reference value, the non-illustrated toner hopper is driven to feed the toner housed therein into the developer container 4 under the direction of a non-illustrated control section.

The runner plate 7 is disposed within the developer container 4, with its one end positioned in the vicinity of the developer regulating member 6 and the developing roller 3 so as to lie on the upstream side in the rotation direction 9*a* of the developing sleeve 9 compared to the developer regulating member 6, and its other end extended so as to lie above the agitating/supplying section 5.

The length of the developer rising in a spicate form formed on the developing roller 3 is regulated to a predetermined value by the developer regulating member 6 so that an adequate amount of the developer for development can be fed to the photoreceptor drum 2. An excess of the developer that has been taken away from the developing sleeve 9 of the developing roller 3 by the developer regulating member 6 is re-used in the developer container 4. In the case of providing the runner plate 7, the removed developer is directed through the runner plate 7 toward the agitating/supplying section 5 which collects the developer. This makes it possible to feed the developer from the agitating/supplying section 5 to the developing roller 3 in a uniform amount.

Also disposed inside the developer container 4 is a toner receiving roller 13 which is positioned on the side opposite from the developing roller 3 with respect to the agitating/supplying section 5. In a part of the developer container 4 which lies above the toner receiving roller 13 is formed a toner supply inlet 14 for effecting the replenishment of toner on the toner receiving roller 13 from the non-illustrated toner hopper. The toner receiving roller 13 allows the toner replenished through the toner supply inlet 14 to disperse under a rotational force exerted by rotation in a direction indicated by an arrow 13*a*. The toner is fed from the toner receiving roller 13 into the developer container 4, particularly to the agitating/supplying section 5.

According to the developing apparatus 1 such as described herein, the dual-component developer including toner and carrier housed in the developer container 4 is agitated by the agitating/supplying section 5 so as to be electrically charged by friction, and the frictionally-charged developer is supplied to the developing roller 3. At the time of the supply, the developer is magnetically attached to the developing sleeve 9 disposed on the surface of the developing roller 3 under the action of the magnetic poles situated inside the developing roller 3, whereupon the developing roller 3 holds the developer. The dual-component developer carried by the developing roller 3 is caused to stand magnetically in a spicate or ear-like form, thereby forming a so-called magnetic brush thereon. The magnetic brush is conveyed to the development area where the photoreceptor drum 2 and the developing roller 3 confront each other while the amount of the developer is being regulated properly by the developer regulating member 6. Of the constituent elements of the developer conveyed to the development area by the rotation of the developing sleeve 9, only the toner is electrostatically moved toward the electrostatic latent image formed on the photoreceptor drum 2 to achieve development.

In recent years, a toner with a small particle size has been widely used to meet the demand for producing higher-resolution images. In a case where such a toner is used in a developing apparatus having paddle-type agitating/supplying section such as the developing apparatus disclosed in JP-A 7-244425 (1995) or the developing apparatus 1 shown in FIGS. 7 and 8, inconveniently, the toner will be electrically charged insufficiently. As a result, a part of the photoreceptor drum 2 other than the electrostatic latent image-bearing part makes contact with the toner, thus causing a problem such as image fogging or undesirable scattering of the toner. This is because, the agitation of the developer is carried out by a single blade member alone during the time the agitating/supplying section makes one turn, and therefore the developer is fed to the developing roller 3 with the toner kept in an insufficiently-charged state.

As another drawback, in the developing apparatus having the paddle-type agitating/supplying section, a plurality of paddle-like blade members are arranged in parallel, each of which is angled relatively to the rotation axis of the rotary shaft member. In the case where all of the blade members are arranged in the same direction in that way, the developer tends to be one-sidedly fed to the developing roller. As a result, at the time of supplying the developer to the developing roller, the amount of the developer received by one end and its periphery of the developing roller is smaller than the amount of the developer received by the other end and its periphery, as well as that received by the midportion and its periphery thereof. That is, the developing apparatus having the paddle-type agitating/supplying section fails to supply the developer to the developing roller uniformly in its lengthwise direction.

SUMMARY

In one aspect, a developing apparatus having agitating/supplying section which is capable of providing enhanced developer stirrability and supplying a developer to a developing roller uniformly in its lengthwise direction is provided.

The developing apparatus can include a developing roller which is freely rotatably disposed so as to face an image bearing member on which an electrostatic latent image is formed when exposed to light in accordance with image information; a developer container for housing a developer; and an agitating/supplying section for agitating the developer housed in the developer container and supplying the developer to the developing roller.

The agitating/supplying section includes a rotary shaft member which is made rotatable about its rotation axis, a plurality of blade support members disposed intersectionally with respect to the rotation axis of the rotary shaft member, and a plurality of blade members formed between respective adjacent blade support members so as to be arranged around the rotation axis of the rotary shaft member and extend in a direction of the rotary shaft member.

In another aspect, a developing apparatus is provided having agitating/supplying section that includes a rotary shaft member which is made rotatable about its axis, a plurality of blade support members disposed intersectionally with respect to the rotation axis of the rotary shaft member, and a plurality of blade members arranged around the rotation axis of the rotary shaft, each of which is so disposed between adjacent blade support members as to extend in the direction of the rotation axis of the blade support members. Thus constructed, in the agitating/supplying section of the developing apparatus, during the time of making one turn, the developer can be agitated by a plurality of blade members, and also the supply of the developer to the developing roller can be achieved over several times by a plurality of blade members. This makes it possible to enhance the development-agent stirrability, as well as to increase the amount of the developer to be supplied to the developing roller. Moreover, since the blade members are so formed as to extend in the direction of the rotation axis, it follows that the developer can be supplied to the developing roller uniformly in its lengthwise direction.

It is preferable that six or more blade members are disposed between respective adjacent blade support members. By arranging the blade members in number of six or more between respective adjacent blade support members, it is possible to enhance the development-agent stirrability, as well as to increase the amount of the developer to be supplied to the developing roller even further.

It is preferable that the blade member is so formed as to incline at an angle to a rotation axis-including virtual plane having a line segment which connects the rotation axis with a part of the blade member which is fitted to the blade support member. In the case where the blade member is angled relatively to the virtual plane in that way, it is possible to increase the amount of the developer to be scooped out of the bottom portion of the developer container, wherefore the developer stirrability can be enhanced even further.

It is preferable that the blade member is so formed as to incline at an angle to the direction of the rotation axis. In this case, the developer can be agitated not only in the direction of rotation of the rotary shaft member but also in the direction of the rotation axis. This makes it possible to disperse the developer in several directions and thereby agitate it more effectively.

It is preferable that the blade members are so formed that a pair of adjacent blade members are plane-symmetrical with respect to a virtual plane including the blade support member. In this case, since the adjacent blade members are so arranged as to incline relative to each other in a staggered manner, it follows that the developer can be agitated while circulating in the direction of the rotation axis with enhanced developer stirrability. Moreover, the developer can be supplied to the developing roller uniformly in its lengthwise direction.

It is preferable that, of the blade members, the one positioned at each rotation axis-wise end of the agitating/supplying section is, on one side thereof located at the corresponding end of the agitating/supplying section, inclined at a sweep-back angle with respect to the rotation axis in the direction of rotation of the rotary shaft member. In this case, the developer to be fed to the developing roller by the blade members positioned at both rotation axis-wise ends of the agitating/supplying section is allowed to travel toward both rotation axis-wise ends of the developing roller. This makes it possible to supply the developer in a sufficient amount even to the end portions of the developing roller that are liable to receive a decreased amount of the developer.

It is preferable that the blade support member has a notch formed around an edge thereof. By forming a notch at the outer edge of the blade support member, it is possible to allow the developer to flow smoothly in the direction of the rotation axis, and thereby improve the dispersibility of the development agent in the direction of the rotation axis with no deterioration in the developer stirrability.

It is preferable that in the blade support members an opening is formed so that the rotary shaft member penetrates the opening, except for the one positioned outermost in the direction of the rotation axis and the blade member and the rotary shaft member are disposed apart from each other. In this case, the developer scooped out of the bottom portion of the developer container by the blade members is allowed to come down gravitationally after passing through the space created between the rotary shaft member and the blade support member as well as the space created between the blade member and the rotary shaft member. At this time, the developer particles can be mingled together by exploiting a gravitational force, whereby the developer stirrability can be enhanced even further.

It is preferable that a developer retaining portion be provided that provides a connection between the rotary shaft member-facing ends of the adjacent blade members. As the rotational speed of the rotary shaft member is decreased, the developer scooped up by the blade members rotating in accompaniment with the rotation of the rotary shaft member will be liable to drop before it is rotationally raised at the maximum height by the agitating/supplying section. In light of this, by providing such a developer retaining portion, the developer scooped up by the blade members is allowed to drop after it is rotationally raised at the maximum height. As a result, even if the rotary shaft member rotates at a lower speed, the developer particles can be agitated and mingled together thoroughly by exploiting a gravitational force.

It is preferable that the agitating/supplying section includes a single, common rotary shaft member and a plurality of agitating/supplying members sharing the rotary shaft member, and the agitating/supplying members each comprise the plurality of blade support members and the plurality of blade members. In this case, it is possible to divide the agitating/supplying section to form the blade support members and a plurality of agitating/supplying members including the blade members. Accordingly, the agitating/supplying section, although it has a complicated configuration in which the blade support member has the opening and a space is created between the blade member and the rotary shaft member, can be produced with ease.

It is preferable that the rotary shaft member has, at both ends, developer adherence preventive members for preventing the developer from adhering to a shaft bearing on which the rotary shaft member is supported from 23 to 22. This makes it possible to inhibit the developer from finding its way into the shaft bearing, and thereby prevent sticking of the developer that will eventually cause damage such as breakage of a gear.

According to the invention, the rotary shaft member has, at both ends, developer adherence preventive members for preventing the developer from adhering to a shaft bearing on which the rotary shaft member is supported. This makes it possible to inhibit the developer from finding its way into the shaft bearing, and thereby prevent sticking of the developer that will eventually cause damage such as breakage of a gear.

BRIEF DESCRIPTION OF THE DRAWINGS

Other and further objects, features, and advantages of the disclosed technology will be more explicit from the following detailed description taken with reference to the drawings wherein.

DETAILED DESCRIPTION

Figure 1:
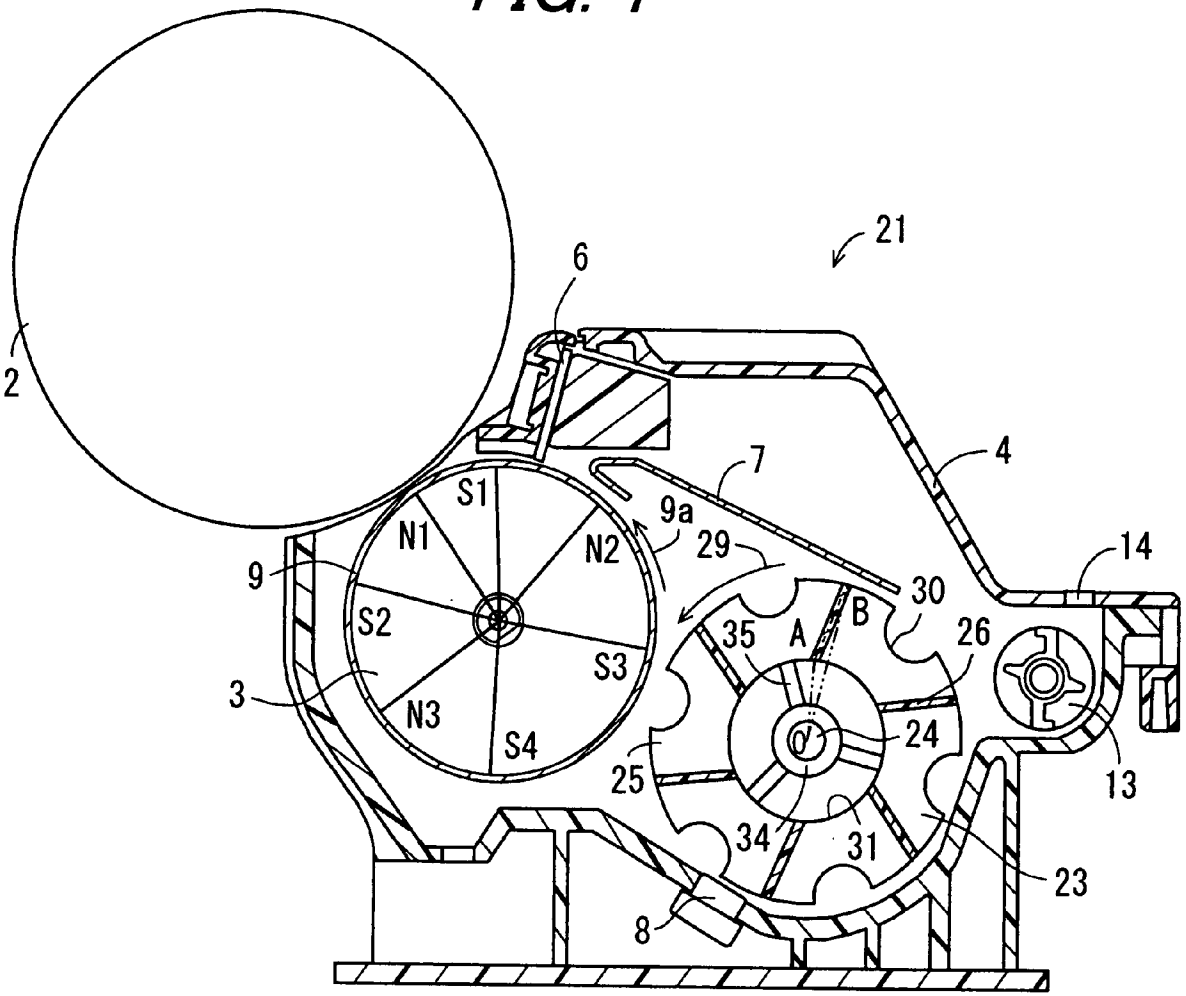
FIG. 1 is a sectional view schematically showing the constitution of a developing apparatus according to one embodiment.

Now referring to the drawings, preferred embodiments of the technology are described below.

Figure 2:
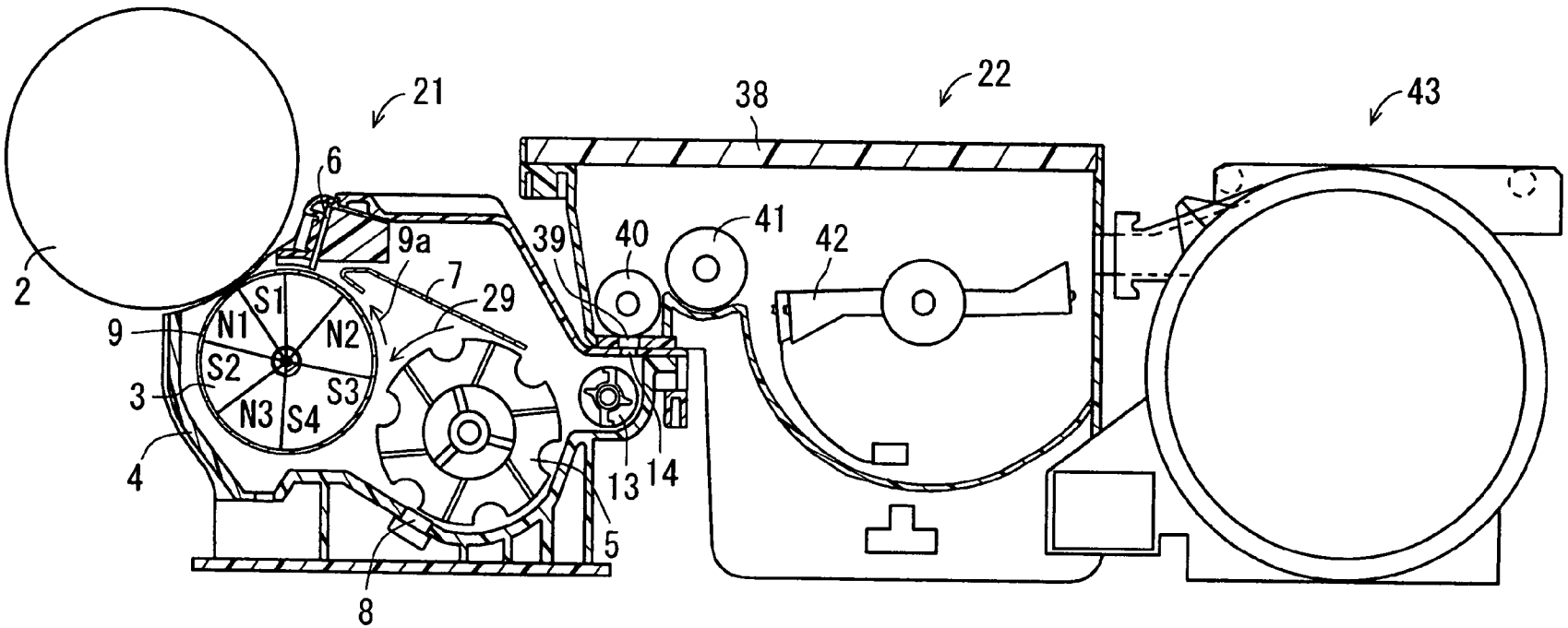
FIG. 2 is a sectional view schematically showing the constitutions of the developing apparatus depicted in FIG. 1 and a toner hopper.
Figure 3:
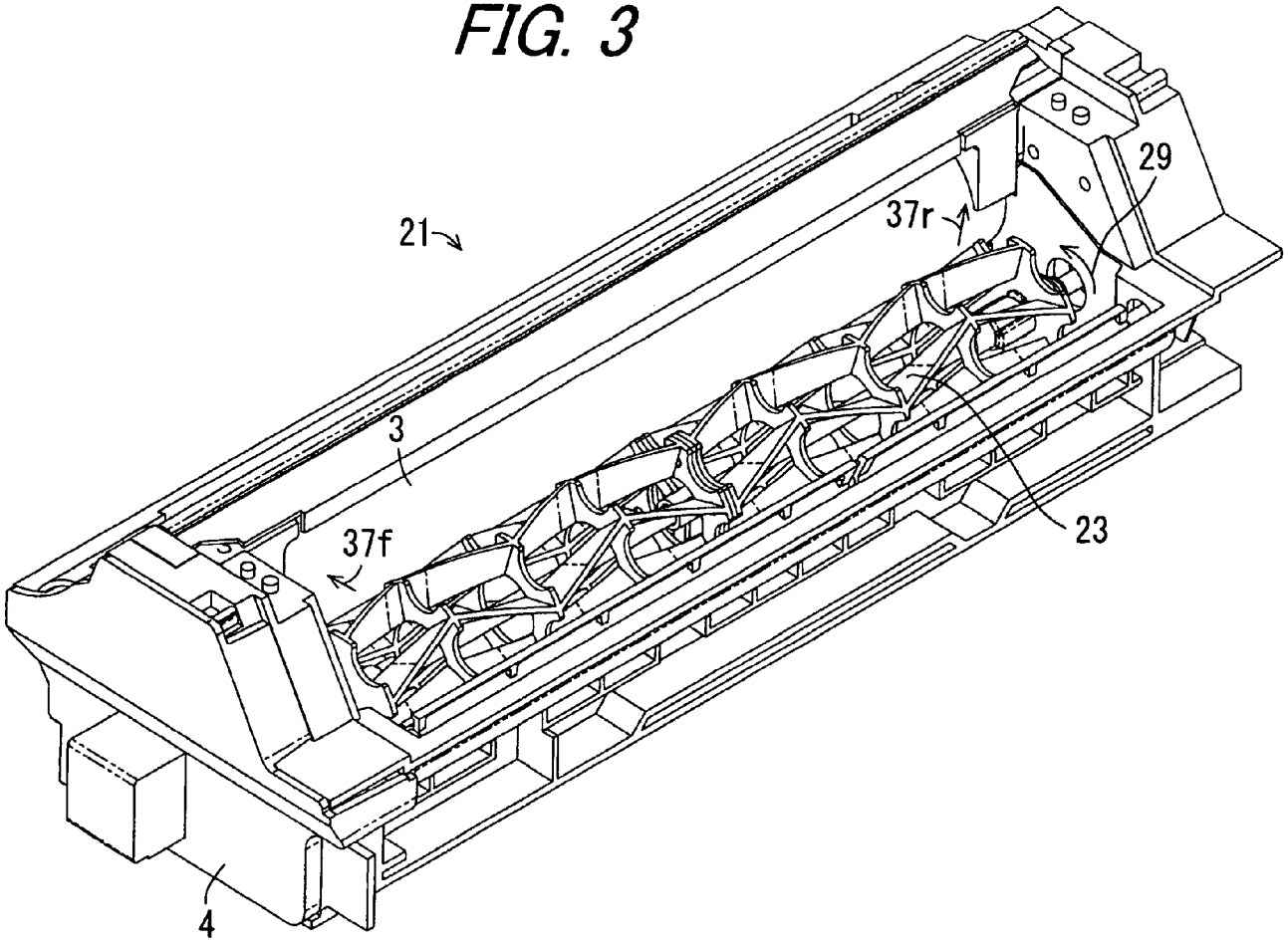
FIG. 3 is a perspective view of the developing apparatus depicted in FIG. 1.
Figure 4:
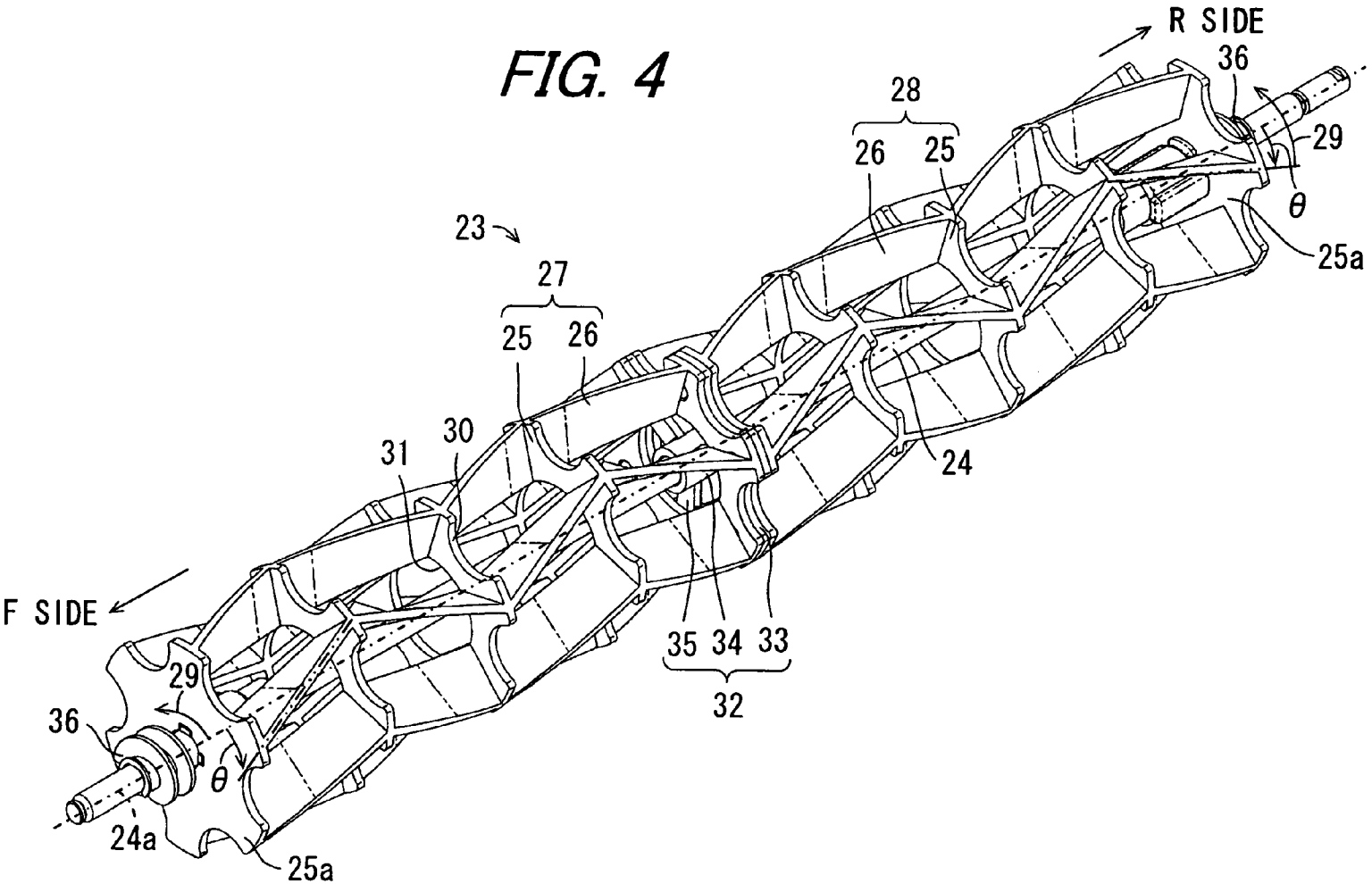
FIG. 4 is a perspective view of agitating/supplying section incorporated in the developing apparatus depicted in FIG. 1.

FIG. 1 is a sectional view schematically showing the constitution of a developing apparatus according to one embodiment. FIG. 2 is a sectional view schematically showing the constitutions of the developing apparatus 21 depicted in FIG. 1 and a toner hopper 22. FIG. 3 is a perspective view of the developing apparatus 21 depicted in FIG. 1. FIG. 4 is a perspective view of agitating/supplying section 23 incorporated in the developing apparatus 21 depicted in FIG. 1. The developing apparatus 21 is mounted in an electrophotographic image forming apparatus for the purpose of developing an electrostatic latent image formed on a photoreceptor drum 2 of the image forming apparatus to form a toner image.

Figure 7:
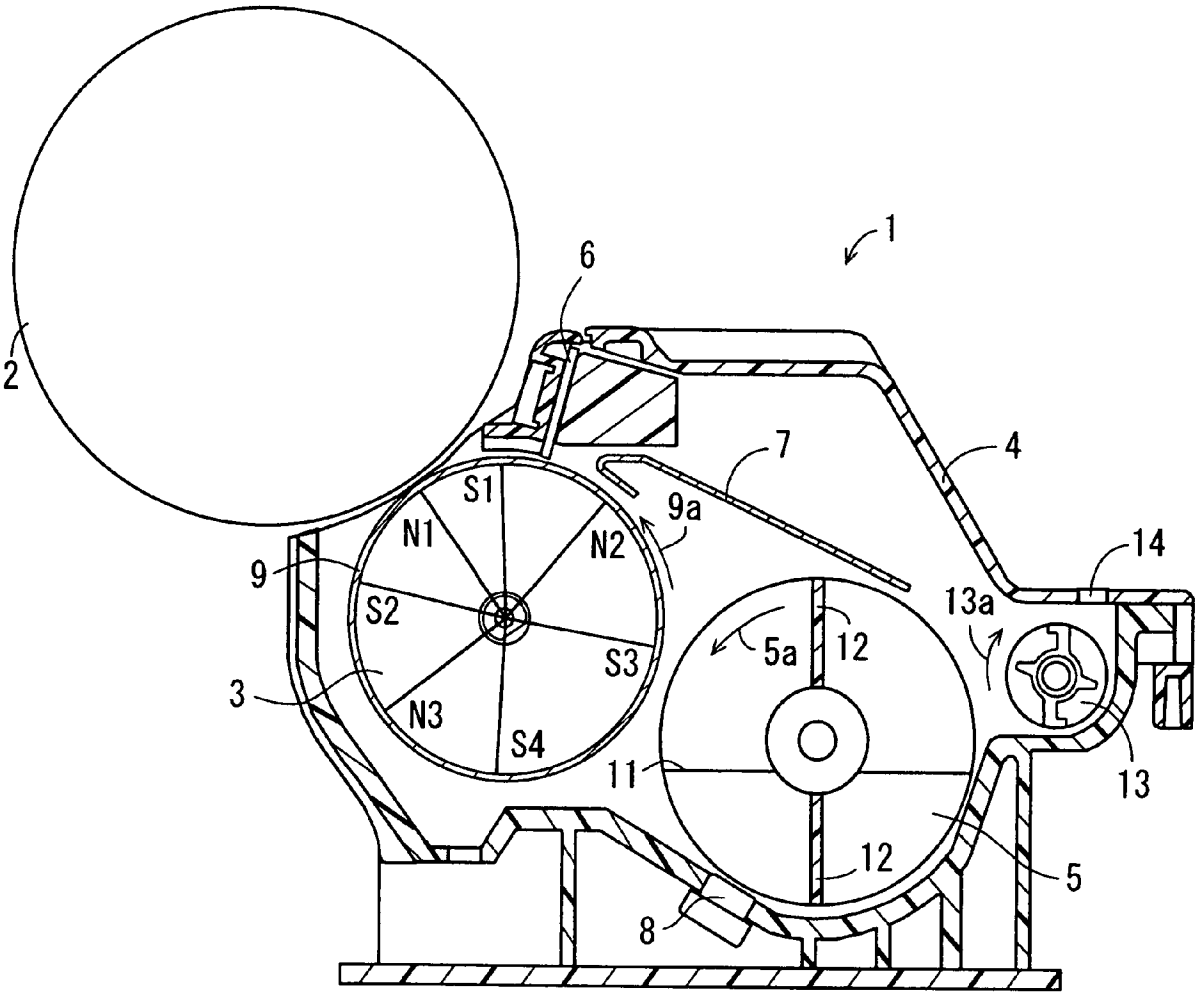
FIG. 7 PRIOR ART
FIG. 7 is a simplified sectional view showing the constitution of a developing apparatus having a paddle-type agitating/supplying section.
Figure 8:
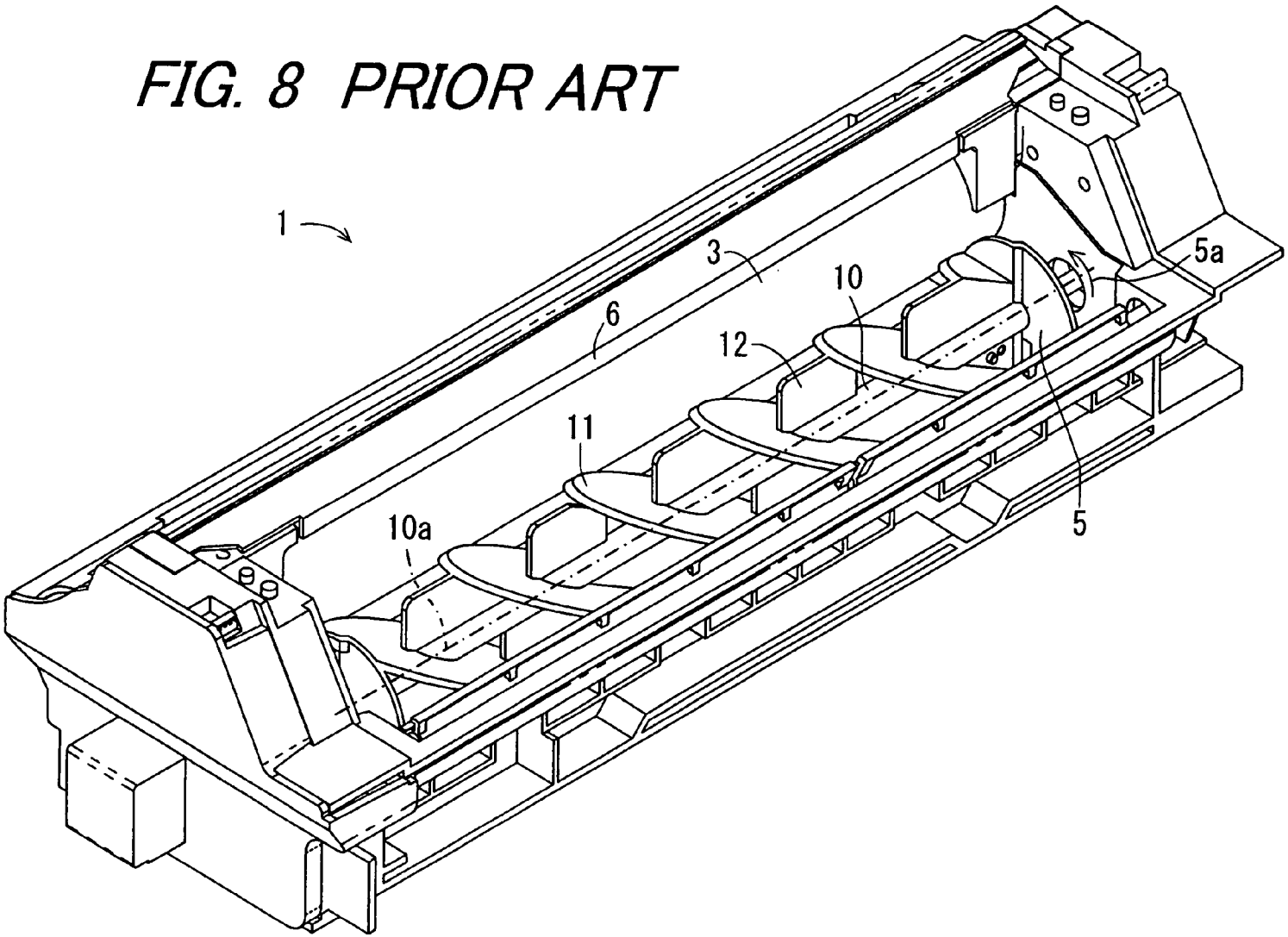
FIG. 8 PRIOR ART
FIG. 8 is a perspective view of the developing apparatus depicted in FIG. 7.

Regarding the developing apparatus 21, the constituent components that play the same or corresponding roles as in the developing apparatus 1 of FIG. 7 will be identified with the same reference symbols, and overlapping descriptions will be omitted. The developing apparatus 21 includes a developing roller 3, a developer container 4 for housing a developer, and agitating/supplying section 23. The developing roller 3 is freely rotatably disposed so as to face the photoreceptor drum 2 which is exposed to light in accordance with image information to form an electrostatic latent image thereon. The agitating/supplying section 23 agitates the developer housed in the developer container 4 and supplies the agitated developer to the developing roller 3. The agitating/supplying section 23 is composed of a rotary shaft member 24, a blade support member 25, and a blade member 26. The rotary shaft member 24 is made rotatable about its axis, namely a rotation axis 24*a*. A plurality of the blade support members 25 are arranged intersectionally with respect to the rotation axis 24*a* of the rotary shaft member 24. The blade member 26 is formed between the adjacent blade support members 25 so as to extend in the direction of the rotation axis 24*a*. A plurality of the blade members 26 are arranged at intervals around the rotation axis 24*a* of the rotary shaft member 24.

The rotary shaft member 24 is disposed with its rotation axis 24*a* aligned with the axial direction of the developing roller 3. For example, a metallic shaft body such as stainless steel having an outer diameter of 8 mm is used as the rotary shaft member 24. The rotary shaft member 24 is freely rotatably supported by a non-illustrated shaft bearing disposed within the developer container 4, and is also connected to non-illustrated rotationally-driving section. The rotary shaft member 24 is driven to rotate counterclockwise as seen in FIG. 1, namely in a direction indicated by an arrow 29, at 40 through 400 rpm, for example.

The agitating/supplying section 23 of the developing apparatus 21 of the embodiment includes the single, common rotary shaft member 24 and a plurality of agitating/supplying members 27 and 28 (two in the embodiment) sharing the rotary shaft member 24. Hereafter, the agitating/supplying members 27 and 28 will be referred to as "the first agitating/supplying member 27" and "the second agitating/supplying member 28", respectively. The first agitating/supplying member 27 is positioned alongside of a user-operable operating panel incorporated in the image forming apparatus. That is, when viewed in FIG. 4, the first agitating/supplying member 27 is positioned on the lower-right side, namely the front side (hereafter referred to simply as "the F side"). Oppositely, the second agitating/supplying member 28 is positioned on the upper-left side, namely the rear side (hereafter referred to simply as "the R side"). The first and second agitating/supplying members 27 and 28 have basically the same structure, the only difference being the configuration of part of the blade support members 25. Therefore, the constitution of the first agitating/supplying member 27 will representatively be explained below and no description will be given as to the second agitating/supplying member 28.

The first agitating/supplying member 27 includes a plurality (in this embodiment, 5 pieces) of the blade support members 25 which are arranged intersectionally with respect to the rotation axis 24*a* of the rotary shaft member 24 at intervals in the direction of the rotation axis. Between the adjacent blade support members 25 are formed the blade members 26 so as to extend in the direction of the rotation axis 24*a*.

Six pieces of the blade support members 25 are arranged parallely at intervals in a direction perpendicular to the rotation axis 24*a* of the rotary shaft member 24. For example, a substantially disk-shaped member made of hard resin such as ABS (Acrylonitrile Butadiene Styrene) resin containing glass fiber is used to form the blade support member 25. In the present non-limiting embodiment, the blade support member 25 is formed in substantially a disk shape with an outer diameter of 50 mm and a thickness of 2 mm.

The blade support member 25 has a notch 30 formed at part of its outer edge where no blade member 26 is fitted. The description of the blade member 26 will be given later. Moreover, a circularly shaped opening 31 is formed centrally in the substantially disk-shaped blade support member 25, except for the blade support member 25 positioned outermost at one end of the first agitating/supplying member in the direction of the rotation axis 24*a* (referred to as "the outermost blade support member 25*a*" for the sake of convenience). Depending on the size of the notch 30 formed in the blade support member 25 and the diameter of the rotary shaft member 24, the size of the opening 31 is preferably so determined that its diameter is equal to 40 to 80% of the outer diameter of the blade support member 25. If the diameter of the opening 31 is less than 40% of the outer diameter of the blade support member 25, there arises the risk that the developer cannot flow smoothly in the direction of the rotation axis 24*a*. By way of contrast, if the diameter of the opening 31 is greater than 80% of the outer diameter of the blade support member 25, there arises the risk that the strength of the blade support member 25 in itself can be decreased. From this point of view, the circularly shaped opening 31 formed in the blade support member 25 has, as an example, a diameter of 24 mm, which is equal to 48% of the outer diameter of the blade support member 25. Note that the outermost blade support member 25*a* has, instead of the opening 31, a through hole drilled therein for effecting insertion of the rotary shaft member 24.

The blade member 26 is formed between the adjacent blade support members 25 so as to extend in the direction of the rotation axis 24*a*. For example, a member made of hard resin such as ABS resin containing glass fiber is used to form the blade member 26. The blade member 26 can have, as an example, a thickness of 2 mm, and 6 pieces of the blade members 26 can be arranged around the rotation axis 24*a* of the rotary shaft member 24 and interposed between adjacent ones of the blade support members 25 which are also six in number. Accordingly, it follows that the first agitating/supplying member 27 is provided with 24 pieces of the blade members 26 in total.

The blade member 26 is formed between the adjacent blade support members 25 so as to extend in the direction of the rotation axis 24*a*. For example, a member made of hard resin such as ABS resin containing glass fiber is used to form the blade member 26. In the present embodiment, the blade member 26 has a thickness of 2 mm, and 6 pieces of the blade members 26 are arranged around the rotation axis 24*a* of the rotary shaft member 24 and interposed between adjacent ones of the blade support members 25 which are five in number. Accordingly, it follows that the first agitating/supplying member 27 is provided with 24 pieces of the blade members 26 in total.

The blade member 26 is fitted radially of the rotary shaft member 24 so as to extend from the opening 31 to the outer edge of the blade support member 25. In other words, the blade member 26 is fitted so as to extend from a point A, namely a rotation axis 24*a*-sided point facing the opening 31, to a point B, namely an outer edge-sided point, as seen in the radial direction of the blade support member 25. In other words, the blade member 26 and the rotary shaft member 24 are disposed apart from each other. With this configuration, a space can be created between the rotary shaft member 24 and part of the blade member 26 located near by the rotary shaft member 24.

Moreover, the blade member 26 is so formed as to incline at an angle to a rotation axis 24*a*-including virtual plane having a line segment which connects the rotation axis 24*a* with a part of the blade member 26 which is fitted to the blade support member 25. More specifically, in the sectional view shown in FIG. 1, given a point passing through the rotation axis 24*a* of "O", then the blade member 26 is so disposed that a line segment AB included in a virtual plane having the blade support member 25 is angled relatively to both of line segments OA and OB included in the rotation axis 24*a*-including virtual plane for connecting the rotation axis 24*a* with a part of the blade member 26 which is fitted to the blade support member 25.

In the case where the blade member 26 is angled relatively to the virtual plane, a larger amount of the developer can be scooped out of the bottom portion of the developer container 4. This helps enhance the developer stirrability even further.

The blade member 26 is also angled relatively to the direction of the rotation axis 24*a*. Moreover, the blade members 26 are so arranged that a pair of adjacent blade members 26 are plane-symmetrical with respect to a virtual plane including the blade support member 25. That is, in the first agitating/supplying member 27, the adjacent blade members 26 are so arranged as to incline relative to each other in a staggered manner. In this case, the developer can be agitated while circulating in the direction of the rotation axis 24*a*. Besides, the developer can be supplied to the developing roller 3 uniformly in its lengthwise direction.

Further, the blade member 26 fitted to the opening 31-free outermost blade support member 25*a* is, on one side thereof located at the outermost blade support member 25*a*-sided end of the agitating/supplying section 23, inclined at a sweepback angle θ with respect to the rotation axis 24*a* in the direction of rotation 29 of the rotary shaft member 24.

In the first agitating/supplying member 27 such as described herein, the blade support member 25 and the blade member 26 are formed integrally with each other by means of injection molding, for example. The first agitating/supplying member 27 is so disposed that the opening 31-free outermost blade support member 25*a* constitutes an F-sided end portion, with the rotary shaft member 24 inserted through the openings 31 formed in the blade support members 25 and the through hole formed in the outermost blade support member 25*a*.

On the other hand, the second agitating/supplying member 28, which is disposed in plane-symmetrical relation to the first agitating/supplying member 27, is so disposed that the opening 31-free outermost blade support member 25*a* constitutes an R-sided end portion, with the rotary shaft member 24 inserted through the openings 31 formed in the blade support members 25 and the through hole formed in the outermost blade support member 25*a*. In this way, the first and second agitating/supplying members 27 and 28 are built around a single, common rotary shaft member 24. The first and second agitating/supplying members 27 and 28 are fixed to each other by connecting the second agitating/supplying member 28-sided blade support member 25 of the first agitating/supplying member 27 with the first agitating/supplying member 27-sided blade support member 25 of the second agitating/supplying member 28.

A coupling member 32 is interposed between the first agitating/supplying member 27 and the second agitating/supplying member 28 to facilitate their connection. The coupling member 32 is composed of a coupling plate 33, a support tube 34, and a fixing member 35. The coupling plate 33 is provided to secure a wall thickness adequate for the blade support member 25 of the first agitating/supplying member 27 and the blade support member 25 of the second agitating/supplying member 28 to be fixedly attached to each other by screws, for example. The cylindrical-shaped support tube 34 supports the rotary shaft member 24. The fixing member 35 allows the coupling plate 33 to be fixedly supported on the support tube 34. The cylindrical-shaped support tube 34 is disposed inside an opening formed in the coupling plate 33. Through the support tube 34 is inserted the rotary shaft member 24. As the support tube 34 is rotated together with the rotary shaft member 24 inserted thereinto, the coupling plate 33 fixed to the support tube 34 by the fixing member 35 is rotated in the direction indicated by the arrow 29. In synchronism therewith, the first and second agitating/supplying members 27 and 28, fixed to each other via the coupling plate 33, are driven to rotate in the direction indicated by the arrow 29 at the same time. This rotatory motion enables the blade member 26 to agitate the developer housed in the developer container 4 while scooping up the developer present in the bottom portion thereof.

In addition, the rotary shaft member 24 has, at both ends, developer adherence preventive members 36 for preventing the developer from adhering to the non-illustrated shaft bearing on which the rotary shaft member 24 is supported. The developer adherence preventive member 36 is designed as a screw-like member made of a resin material, for example, ABS resin containing glass fiber. As the screw-like developer adherence preventive member 36 is rotated together with the rotary shaft member 24, the developer making its approach to the shaft bearing can be moved in the opposite direction so as to be conveyed centrally in the direction of the rotation axis 24*a*. In this way, the developer is inhibited from finding its way into the shaft bearing during the agitation. By providing the developer adherence preventive member 36, it is possible to prevent sticking of the developer that will eventually cause damage such as breakage of a gear.

In the agitating/supplying section 23 such as described herein, as described previously, the blade member 26 located at each end thereof as seen in the direction of the rotation axis 24*a* of the rotary shaft member 24, namely the blade member 26 fitted to the outermost blade support member 25*a* is, on one side thereof located at the corresponding end of the agitating/supplying section 23, inclined at a sweepback angle θ with respect to the rotation axis 24*a* in the direction of rotation 29 of the rotary shaft member 24.

In the case where the blade member 26 fitted to the outermost blade support member 25*a* is so formed as to incline at a sweepback angle θ with respect to the rotation axis 24*a* in the direction of rotation 29 of the rotary shaft member 24, the developer to be fed to the developing roller 3 by the blade member 26 is allowed to travel toward each of the rotation axis-wise ends of the developing roller 3, as indicated by arrows 37*f* and 37*r* in FIG. 3. This makes it possible to supply the developer in a sufficient amount even to the end portions of the developing roller 3 that are liable to receive a decreased amount of the developer.

Moreover, in the developing apparatus 21, when the toner concentration detected by the toner concentration sensor 8 is found to be equal to or less than a predetermined reference value, the toner hopper 22 is driven to feed the toner housed therein into the developer container 4 under the direction of a non-illustrated control section.

The toner hopper 22 is mainly composed of a hopper main body 38. Like the developer container 4, the hopper main body 38 is formed of a hollow container-shaped member made of hard synthetic resin. The hopper main body 38 has a toner supply inlet for effecting the replenishment of toner on the developer container 4 (referred to as "the hopper-side supply inlet 39"). The toner hopper 22 is disposed adjacent to the developer container 4 in such a manner that the hopper-side supply inlet 39 and the toner supply inlet 14 formed in the developer container 4 are mated with each other to provide communication between the inner space of the toner hopper 22 and the inner space of the developer container 4.

Inside the hopper main body 38 are arranged a toner replenishing roller 40, a toner supply roller 41, and an agitating blade member 42 that are each made freely rotatable. The toner replenishing roller 40 is disposed immediately above the hopper-side supply inlet 39. The toner supply roller 41 serves to feed toner to the toner replenishing roller 40. The agitating blade member 42 agitates and conveys the toner housed in the hopper main body 38.

As the agitating blade member 42 is rotated, the toner housed in the hopper main body 38 is agitated greatly and is then conveyed to the toner supply roller 41. Subsequently, as the toner supply roller 41 is rotated, the toner is fed to the toner replenishing roller 40. By the action of the toner replenishing roller 40, the supplied toner is replenished through the hopper-side supply inlet 39 and the toner supply inlet 14 into the developer container 4. Note that the toner hopper 22 is replenished with toner from a toner cartridge 43.

Thus constructed, in the developing apparatus 21, during the time the agitating/supplying section 23 makes one turn, the developer existing between a pair of the adjacent blade support members 25 can be agitated thoroughly by 6 pieces of the blade members 26, and also the supply of the developer to the developing roller 3 can be achieved by 6 pieces of the blade members 26. This makes it possible to enhance the development-agent stirrability, as well as to increase the amount of the developer to be supplied to the developing roller 3. Moreover, since the blade members 26 are each inclined at an appropriate angle with respect to the direction of the rotation axis 24*a*, it never occurs that an unduly large amount of the developer is supplied only to a certain part of the developing roller 3. As a result, the developer can be supplied in a sufficient amount even to the end portions of the developing roller 3 that are normally liable to receive a decreased amount of the developer. This makes it possible to supply the developer to the developing roller 3 uniformly in its lengthwise direction.

Moreover, by forming the notch 30 in the blade support member 25, it is possible to allow the developer to flow smoothly in the direction of the rotation axis 24*a*, and thereby improve the dispersibility of the development agent in the direction of the rotation axis 24*a* with no deterioration in the developer stirrability.

As another feature, the opening 31 is formed in the blade support member 25, and the blade member 26 and the rotary shaft member 24 are disposed apart from each other. With such a configuration, the developer having been scooped out of the bottom portion of the developer container 4 by the blade member 26 is allowed to come down gravitationally after passing through the space created between the rotary shaft member 24 and the blade support member 25 as well as the space created between the blade member 26 and the rotary shaft member 24. At this time, the developer particles can be mingled together by exploiting a gravitational force, whereby the developer stirrability can be enhanced even further.

As still another feature, in the agitating/supplying section 23, a plurality of the agitating/supplying members 27 and 28 are built around a single, common rotary shaft member 24. In this case, the agitating/supplying member 27, 28 composed of the blade support members 25 and the blade members 26 can be formed separately from the rotary shaft member 24. Accordingly, the agitating/supplying section 23, although it has a complicated configuration in which the blade support member 25 has the notch 30 and the opening 31 and also a space is created between the blade member 26 and the rotary shaft member 24, can be produced without great difficulty.

The developing apparatus 21 is not limited to the constitution illustrated hereinabove, and therefore various modifications are possible. While, in the developing apparatus 21, 6 pieces of the blade members 26 are arranged around the rotation axis 24*a* of the rotary shaft member 24 between the respective adjacent blade support members 25; that is, the agitating/supplying section 23 is provided with 48 pieces of the blade members 26 in total, the number of the blade members 26, as well as the number of the blade support members 25, can be changed suitably with the size of the developing apparatus, the kind of the developer in use, the manufacturing cost, etc. into consideration. Note that, by providing 6 or more pieces of the blade members 26 around the rotation axis 24*a* of the rotary shaft member 24 between the respective adjacent blade support members 25, it is possible to enhance particularly the stirrability of the agitating/supplying section per se, and thereby enable the toner to be electrically charged satisfactorily.

Moreover, while the blade support member 25, the blade member 26, and the developer adherence preventive member 36 are constituted with use of the same material in this embodiment, the invention is not limited thereto. That is, these components can be made of different materials.

Moreover, while, in the developing apparatus 21 of the present embodiment, the blade support member 25, the blade member 26, and the developer adherence preventive member 36 are constituted with use of the same material, the invention is not limited thereto. That is, these components can be made of different materials.

Further, the agitating/supplying section is not limited to the configuration illustrated in the embodiment in which the two agitating/supplying members 27 and 28 are built around a single, common rotary shaft member 24, but may be of another configuration in which 3 or more pieces of the agitating/supplying members are provided. In the case of increasing the number of the agitating/supplying members to 3 or more, the first and second agitating/supplying members 27 and 28 are positioned at both ends of the agitating/supplying section so as to have sandwiched therebetween additional one/ones. In the agitating/supplying member/members other than the agitating/supplying members positioned at both ends of the agitating/supplying section, all of the blade support members are provided with an opening.

Still further, the application of the developing apparatus 21 is not limited to a dual-component developer development process. The developing apparatus 21 can be operated with the use of a carrier-free, mono-component developer.

Figure 5:
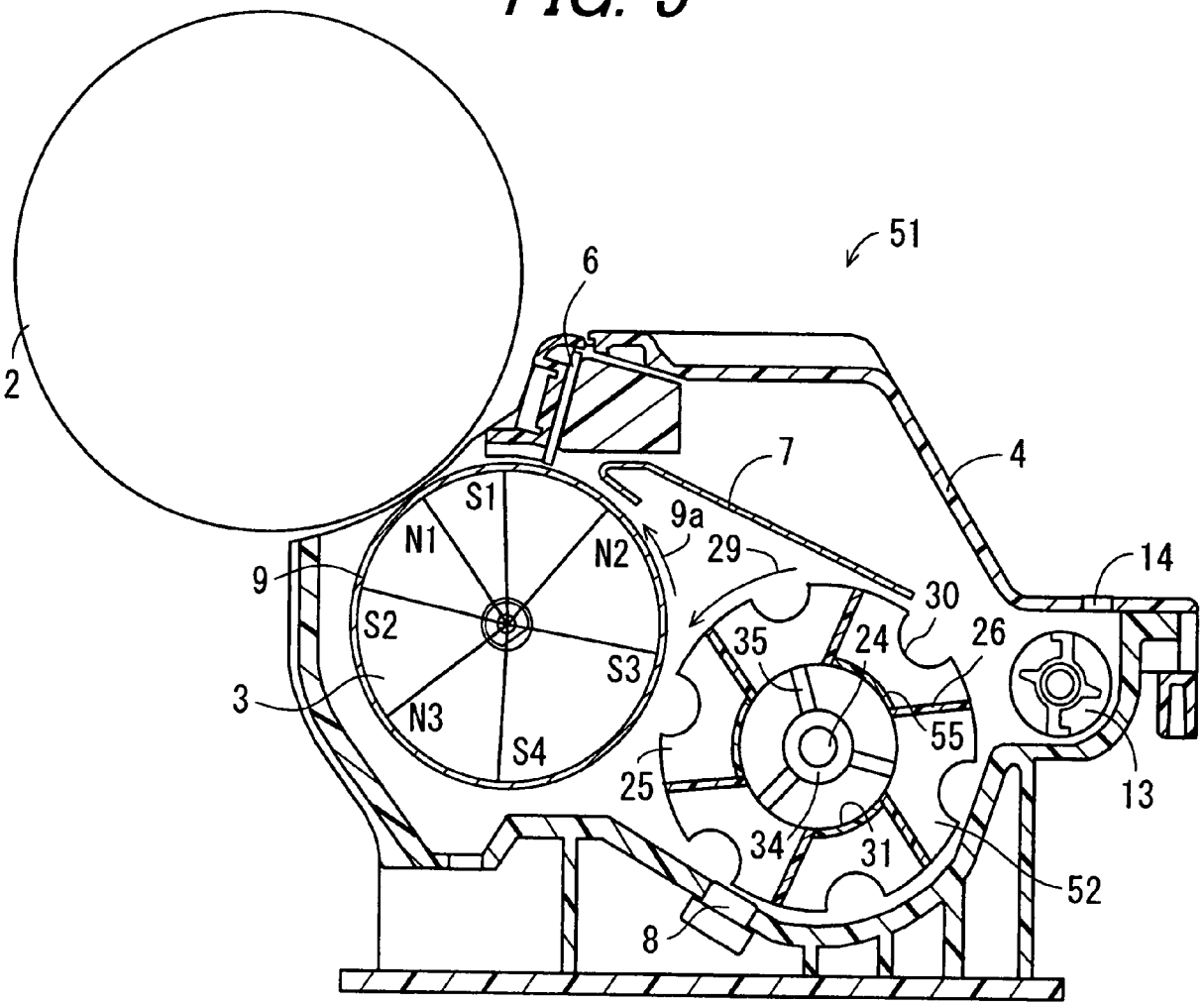
FIG. 5 is a sectional view schematically showing the constitution of a developing apparatus according to another embodiment.
Figure 6:
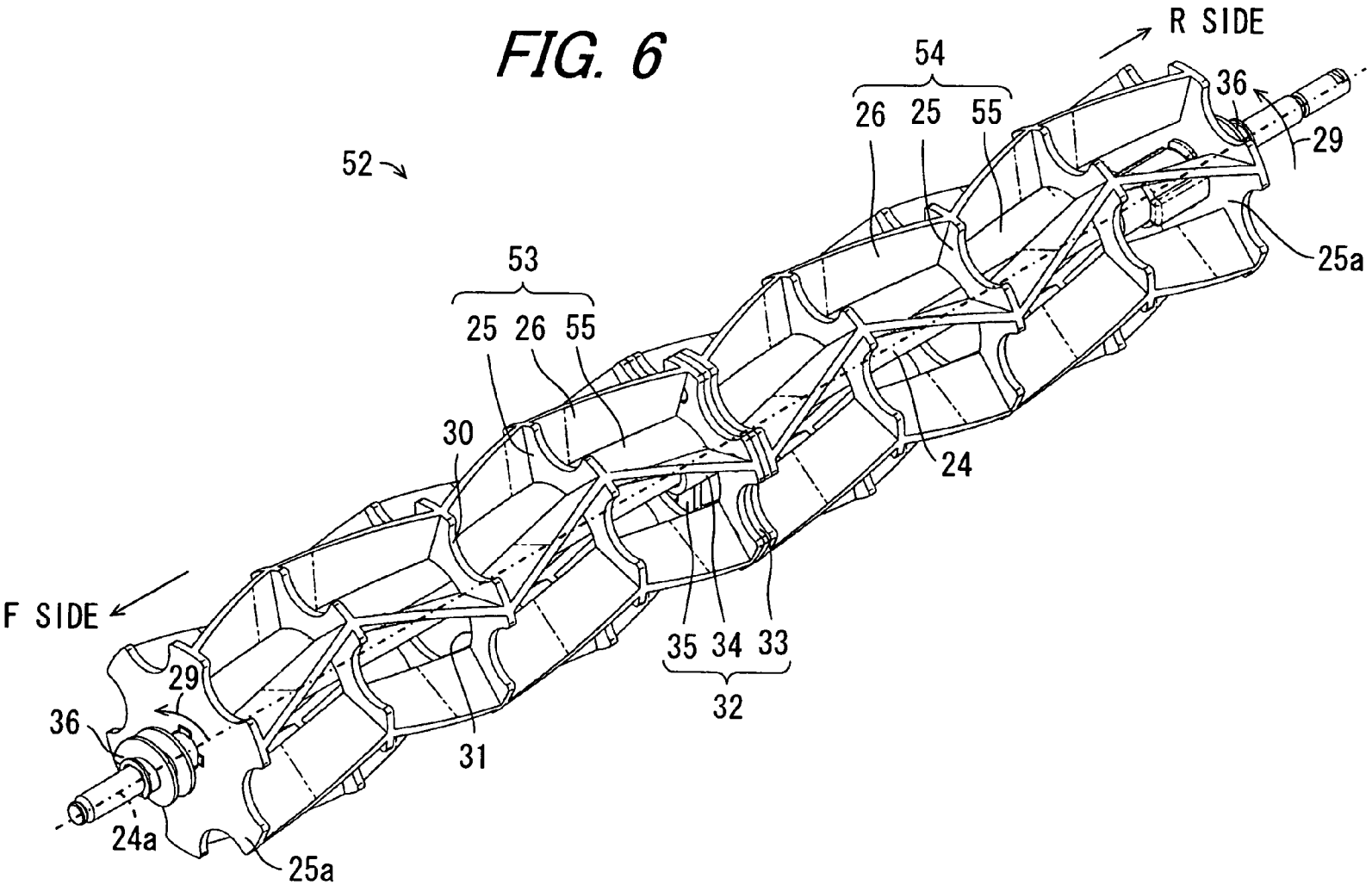
FIG. 6 is a perspective view of agitating/supplying section provided in the developing apparatus depicted in FIG. 5.

FIG. 5 is a sectional view schematically showing the constitution of a developing apparatus 51 accomplished by way of another non-limiting embodiment. FIG. 6 is a perspective view of agitating/supplying section 52 provided in the developing apparatus 51 depicted in FIG. 5.

Regarding the developing apparatus 51 the constituent components that play the same or corresponding roles as in the developing apparatus 21 will be identified with the same reference symbols, and overlapping descriptions will be omitted. The developing apparatus 51 includes developer retaining portions 55. The developer retaining portion 55 is formed in the agitating/supplying section 52 so as to connect together one rotary shaft member 24-facing ends of the adjacent blade members 26.

Like the agitating/supplying section 23 of the preceding embodiment, the agitating/supplying section 52 includes a single, common rotary shaft member 24 and two agitating/supplying members: a first agitating/supplying member 53 and a second agitating/supplying member 54 which share the rotary shaft member 24. The first and second agitating/supplying members 53 and 54 have basically the same structure as the first and second agitating/supplying members 27 and 28, and the difference is that, in the former, the developer retaining portion 55 is included.

Like the agitating/supplying section of the preceding embodiment, the agitating/supplying section 52 includes a single, common rotary shaft member 24 and two agitating/supplying members: a first agitating/supplying member 53 and a second agitating/supplying member 54 which share the rotary shaft member 24. The first and second agitating/supplying members 53 and 54 have basically the same structure as the first and second agitating/supplying members 27 and 28, and the only difference is that, in the former, the developer retaining portion 55 is included.

The developer retaining portion 55 is so formed as to connect together one rotary shaft member 24-facing ends of the adjacent blade members 26. In this embodiment, the developer retaining portions 55 are provided in such a manner that the blade members 26 having their rotary shaft member 24-facing ends connected by the developer retaining portion 55 and the blade members 26 having their rotary shaft member 24-facing ends left unconnected are arranged in an alternating manner when viewed in a section which is perpendicular to the direction of the rotation axis 24*a*. Moreover, the developer retaining portion 55 is so formed as to extend continuously from one end to the other end of the first, second agitating/supplying member 53, 54.

In the developing apparatus 21 of the preceding embodiment, as the rotational speed of the rotary shaft member 24 is decreased, the developer scooped up by the blade members 26 rotating in accompaniment with the rotation of the rotary shaft member 24 will be liable to drop before it is rotationally raised at the maximum height by the agitating/supplying section 23. By way of contrast, in the developing apparatus 51, the developer retaining portion 55 is capable of retaining the developer scooped up by the blade member 26 until it is rotationally raised at the maximum height before being dropped. As a result, even if the rotary shaft member 24 rotates at a lower speed, the developer particles can be agitated and mingled together thoroughly by exploiting a gravitational force.

Hence, the feature of the agitating/supplying section 52 having such a developer retaining portion 55 is especially advantageous if it is mounted in a developing apparatus whose agitating/supplying section is designed to rotate at a relatively low speed in a range of from 40 to 100 rpm, which will be suited for use with a mono-component developer, for example. On the other hand, in the absence of the developer retaining portion 55, the agitating/supplying section 23 of the preceding embodiment is suitable for use particularly in a developing apparatus whose agitating/supplying section is designed to rotate at a relatively high speed in a range of from 150 to 350 rpm, which will be suited for use with a dual-component developer, for example.

EXAMPLES

The developing apparatus 21 as shown in FIG. 1 and the related-art developing apparatus 1 having the paddle-type agitating/supplying section as shown in FIG. 7 were each mounted in an electrophotographic image forming apparatus in order to perform experimental development. In the development process, with the amount of the developer housed in the developer container 4 varied, observation and evaluation were made as to whether the developer was fed to the developing roller sufficiently or not. Note that the concentration of toner contained in the developer was set at 4.5% by weight, and the rotational speed of the agitating/supplying section was set at 194 rpm in each of the developing apparatus 21 and the related-art developing apparatus 1.

Moreover, in expectation of the possibility that the developing apparatus will not be disposed in a horizontal position, the conditions to be fulfilled in setting up the image forming apparatus were variously determined as follows: the developing apparatus is positioned with its F side (front side) located 15 mm higher than its R side (rear side) (i.e. F15 mm condition); the developing apparatus is positioned with its F side (front side) and R side (rear side) located on the same level (i.e. horizontal condition); and the developing apparatus is positioned with its R side (rear side) located 15 mm higher than its F side (front side) (i.e. R15 mm condition). The evaluation results are listed in Table 1.

TABLE 1

| Developing Apparatus | Installation Condition | Amount of developer (g) 650 | 725 | 800 | 900 | 1000 | 1100 | 1200 | 1300 | 1400 | 1450 |
|---|---|---|---|---|---|---|---|---|---|---|---|
| Embodiment | F15 mm | ○ | ○ | ○ | ○ | ○ | ○ | ○ | ○ | | |
| | Horizontal | ○ | ○ | ○ | ○ | ○ | ○ | ○ | ○ | | |
| | R15 mm | ○ | ○ | ○ | ○ | ○ | ○ | ○ | ○ | | |
| Related Art | F15 mm | x | x | x | x | x | x | x | x | ○ | ○ |
| | Horizontal | x | x | x | x | x | x | x | ○ | ○ | ○ |
| | R15 mm | x | x | x | x | x | x | x | x | ○ | ○ |

As will be understood from the evaluation results listed in Table 1, whereas the related-art developing apparatus having the paddle-type agitating/supplying section necessitates 1400 grams of the developer to supply toner sufficiently to the developing roller, the developing apparatus 21 necessitates only 650 grams of the developer to achieve the same. The point is that, in the developing apparatus 21, even if the amount of toner is small, carrier and toner, as well as contiguous toner particles, can be electrically charged satisfactorily by mutual friction, thus attaining high stirrability.

Moreover, in the related-art developing apparatus having the paddle-type agitating/supplying section, at the time of charging the toner through agitation under the condition that 1400 grams of the developer is replenished from the toner hopper into the developer container, a time period of as long as 50 seconds was required to complete the charging. By way of contrast, in the developing apparatus 21, at the time of charging the toner through thorough agitation under the condition that 650 grams of the developer is replenished, only a time period of as short as approximately 12 seconds was required to complete the charging. The point is that, in the developing apparatus 21, as compared with the related-art developing apparatus having the paddle-type agitating/supplying section, the toner can be electrically charged satisfactorily with a smaller amount of the developer. This makes it possible to effect charging on the toner in a shorter period of time upon the replenishment of the toner, and thereby shorten the time taken to change the mode of the developing apparatus from a toner-replenishment standby status to an operating status.

Also evaluated was the chargeability of the toner supplied to the developing roller in each of the developing apparatus 21 and the related-art developing apparatus having the paddle-type agitating/supplying section. To begin with, 20 grams of toner was added to the developer container containing 1400 grams of the developer. Then, the agitating/supplying section was driven to rotate at 194 rpm to agitate the developer so as for the toner to be electrically charged. In this state, development was carried out. After that, a comparison was made between the concentration of the toner of the developer attached to the developing roller and the concentration of the toner of the developer existing within part of the developer container located in the vicinity of the developing roller.

In the case of using the developing apparatus 21, after the completion of the development, the concentration of the toner of the developer attached to the developing roller was found to be lower than that of the toner of the developer existing within part of the developer container located in the vicinity of the developing roller. It will thus be seen that, in the developing apparatus 21, the toner supplied to the developing roller was kept in a fully-charged state in preparation for image formation. In contrast to this, in the case of using the related-art developing apparatus having the paddle-type agitating/supplying section, after the completion of the development, the concentration of the toner of the developer attached to the developing roller was found to remain high, whereas the concentration of the toner of the developer existing within part of the developer container located in the vicinity of the developing roller was found to be equal to the concentration of the toner of the developer yet to be added with 20 grams of toner. This means that the toner has been supplied to the developing roller before being fully charged, with the result that part of the toner in an insufficiently-charged state remains on the surface of the developing roller without moving toward the photoreceptor drum. In conclusion, it has been confirmed that, in the embodiments of the developing apparatuses, by virtue of the agitating/supplying section, the toner is agitated thoroughly and is thereby electrically charged satisfactorily.

The technology described herein may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A developing apparatus, comprising:

a developing roller which is freely rotatably disposed so as to face an image bearing member on which an electrostatic latent image is formed when exposed to light in accordance with image information;

a developer container for housing a developer; and an agitating/supplying section for agitating the developer housed in the developer container and supplying the developer to the developing roller, wherein the agitating/supplying section comprises:

a rotary shaft member which is made rotatable about its rotation axis;

a plurality of blade support members disposed intersectionally with respect to the rotation axis of the rotary shaft member; and a plurality of blade members formed between respective adjacent blade support members so as to be arranged around the rotation axis of the rotary shaft member and extend in a direction of the rotary shaft member, wherein in the plurality of blade support members, an opening is formed so that the rotary shaft member penetrates the opening, except for the one positioned outermost in the direction of the rotation axis, and the blade member and the rotary shaft member are disposed apart from each other.

2. The developing apparatus of claim 1, wherein six or more blade members are disposed between respective adjacent blade support members.

3. The developing apparatus of claim 1, wherein the blade member is so formed as to incline at an angle to a rotation axis-including virtual plane having a line segment which connects the rotation axis with a part of the blade member which is fitted to the blade support member.

4. The developing apparatus of claim 1, wherein the blade member is so formed as to incline at an angle to the direction of the rotation axis.

5. The developing apparatus of claim 4, wherein the blade members are so formed that a pair of adjacent blade members are plane-symmetrical with respect to a virtual plane including the blade support member.

6. The developing apparatus of claim 1, wherein, of the blade members, the one positioned at each rotation axis-wise end of the agitating/supplying section is, on one side thereof located at the corresponding end of the agitating/supplying section, inclined at a sweepback angle with respect to the rotation axis in the direction of rotation of the rotary shaft member.

7. The developing apparatus of claim 1, wherein the blade support member has a notch formed around an edge thereof.

8. The developing apparatus of claim 1, wherein provided is a developer retaining portion that provides a connection between the rotary shaft member-facing ends of the adjacent blade members.

9. The developing apparatus of claim 1, wherein the agitating/supplying section includes a single, common rotary shaft member and a plurality of agitating/supplying members sharing the rotary shaft member, and the agitating/supplying members each comprise the plurality of blade support members and the plurality of blade members.

10. The developing apparatus of claim 1, wherein the rotary shaft member has, at both ends, developer adherence preventive members for preventing the developer from adhering to a shaft bearing on which the rotary shaft member is supported.

11. A developing apparatus, comprising:

a developing roller which is freely rotatably disposed so as to face an image bearing member on which an electrostatic latent image is formed when exposed to light in accordance with image information;

a developer container for housing a developer; and an agitating/supplying section for agitating the developer housed in the developer container and supplying the developer to the developing roller, wherein the agitating/supplying section comprises:

a rotary shaft member which is rotatable about its rotation axis;

a plurality of blade support members arranged at intervals in a direction substantially perpendicular to the rotation axis of the rotary shaft member; and a plurality of blade members formed between respective adjacent blade support members so as to be arranged around the rotation axis of the rotary shaft member and extend in a direction of the rotary shaft member, and wherein the plurality of blade member are so formed as to incline at an angle to the direction of the rotation axis, and wherein the plurality of blade members are so formed that a pair of adjacent blade members are plane-symmetrical with respect to a virtual plane defined by the blade support member.

12. The developing apparatus of claim 11, wherein in the plurality of blade support members, an opening is formed so that the rotary shaft member penetrates the opening, except for the one positioned outermost in the direction of the rotation axis, and the blade member and the rotary shaft member are disposed apart from each other.

13. The developing apparatus of claim 12, wherein the agitating/supplying section comprises further comprises a plurality of developer retaining portions, each formed to connect together rotary shaft member facing ends of adjacent blade members.

14. The developing apparatus of claim 12, wherein a diameter of the opening ranges substantially between 40% and 80% of an outer diameter of the blade support members.

15. The developing apparatus of claim 11, wherein the blade member is so formed as to incline at an angle to a rotation axis including virtual plane having a line segment which connects the rotation axis with a part of the blade member which is fitted to the blade support member.

16. The developing apparatus of claim 11, wherein, of the blade members, the one positioned at each rotation axis-wise end of the agitating/supplying section is, on one side thereof located at the corresponding end of the agitating/supplying section, inclined at a sweepback angle with respect to the rotation axis in the direction of rotation of the rotary shaft member.

17. The developing apparatus of claim 11, wherein the agitating/supplying section includes a single, common rotary shaft member and a plurality of agitating/supplying members sharing the rotary shaft member, and the agitating/supplying members each comprise the plurality of blade support members and the plurality of blade members.

18. The developing apparatus of claim 11, wherein the blade support member has a notch formed around an edge thereof.

* * * * *